US005300212A

United States Patent [19]

Winter, Jr.

[11] Patent Number: 5,300,212

[45] Date of Patent: Apr. 5, 1994

[54] HYDROCONVERSION PROCESS WITH SLURRY HYDROTREATING

[75] Inventor: William E. Winter, Jr., Baton Rouge, La.

[73] Assignee: Exxon Research & Engineering Co., Florham Park, N.J.

[21] Appl. No.: 965,107

[22] Filed: Oct. 22, 1992

[51] Int. Cl.[5] ..... C10G 45/04; C10G 1/00; C10G 45.00; C10L 1/18

[52] U.S. Cl. ..... 208/67; 208/49; 208/89

[58] Field of Search ..... 208/49, 67

[56] References Cited

U.S. PATENT DOCUMENTS

| | | | |
|---|---|---|---|
| 4,138,227 | 2/1979 | Wilson et al. | 208/67 |
| 5,049,258 | 9/1991 | Keim et al. | 208/67 |
| 5,228,978 | 7/1993 | Taylor et al. | 208/49 |

FOREIGN PATENT DOCUMENTS

| | | | |
|---|---|---|---|
| 1228316 | 10/1987 | Canada . | |
| 8303722 | 6/1984 | Netherlands | 208/49 |

*Primary Examiner*—David B. Springer
*Attorney, Agent, or Firm*—Henry E. Naylor

[57] ABSTRACT

Disclosed is a process wherein a two-stage hydroconversion process for converting a heavy hydrocarbonaceous feedstock to lower boiling products which process comprises: (a) reacting the feedstock in a first reaction stage at hydroconversion conditions which include temperature from about 650° F. to 900° F., and hydrogen partial pressure ranging from about 50 to 5000 psig in the presence of a metal compound which is convertible to a solid, non-colloidal, metal-containing catalyst, said metal selected from the group consisting of metals from Groups IVB, VB, VIB, VIIB, and VIII, of the Periodic Table of the Elements, wherein said metal compound is: (i) soluble in the hydrocarbonaceous feed; or (ii) soluble in an organic medium that can be dispersed in the hydrocarbonaceous oil, or (iii) soluble in water resulting in an aqueous solution which can then be dispersed in the hydrocarbonaceous feedstock; (b) passing the resulting product stream to a second reaction stage where it is reacted under slurry hydrotreating conditions which include: (i) temperature in the range of 650° F. to 750° F., with the promise that this slurry hydrotreating stage be operated at a temperature at least 25° F. less than the first stage, and (ii) hydrogen partial pressures in the range of 800 to 4000 psig, and in the presence of hydrogen and a hydrotreating catalyst comprised of at least one Group VI metal and at least one Group VIII catalyst, on an inorganic oxide support.

4 Claims, 1 Drawing Sheet

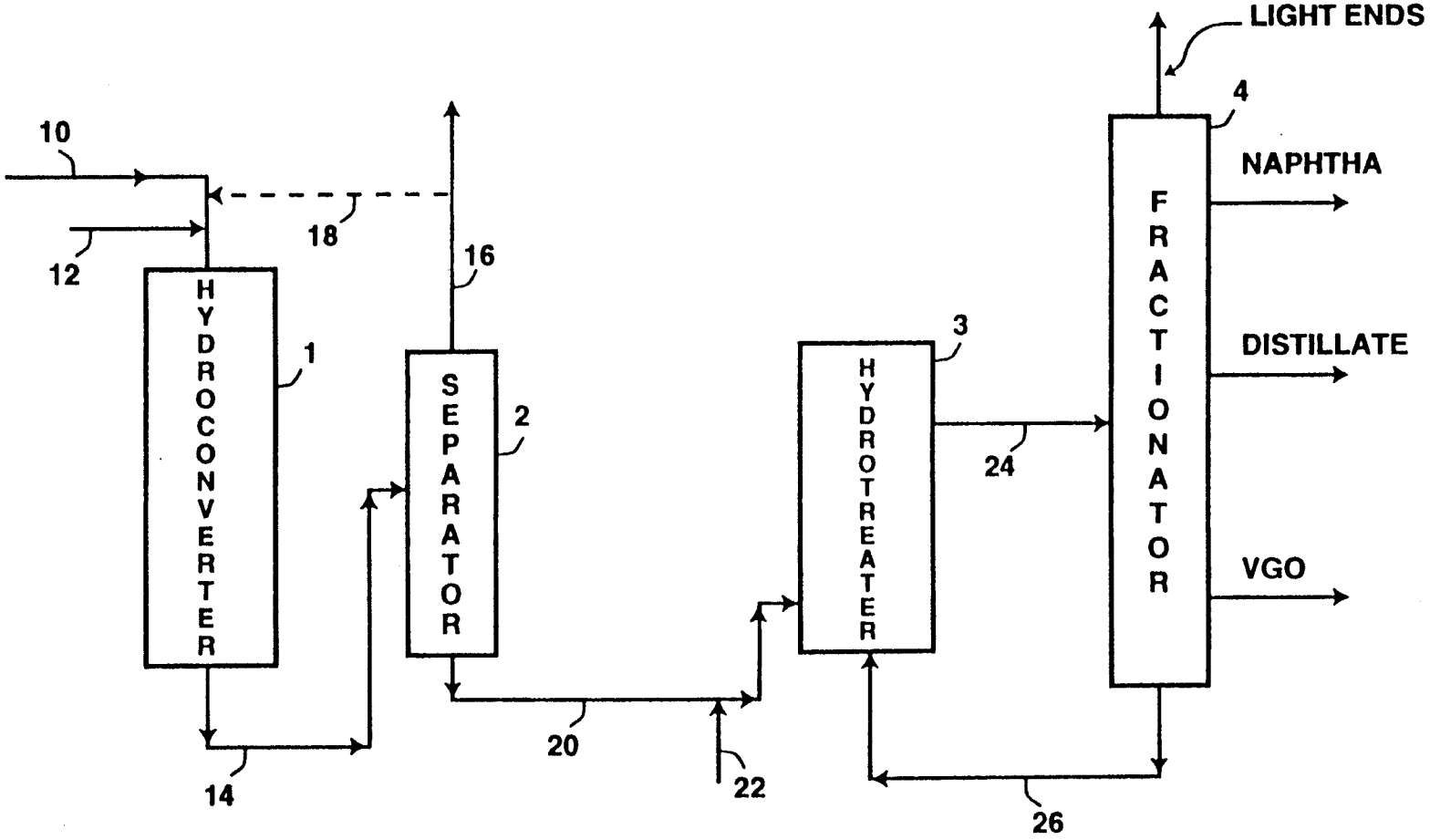
LIGHT ENDS
NAPHTHA
DISTILLATE
VGO
4
FRACT-ONATOR
24
26
3
HYDROTREATER
22
20
2
SEPARATOR
16
18
1
HYDROCONVERTER
14
10
12

HYDROCONVERSION PROCESS WITH SLURRY HYDROTREATING

FIELD OF THE INVENTION

This invention relates to a two-stage hydroconversion process comprised of a first hydroconversion stage followed by a second slurry hydrotreating stage. The slurry hydrotreating stage is operated at a lower temperature than the hydroconversion stage and in the presence of a supported hydrotreating catalyst.

BACKGROUND OF THE INVENTION

There is substantial interest in the petroleum industry for converting heavy hydrocarbonaceous feedstocks to lower boiling liquids. One type of process suitable for hydroconversion of heavy feedstocks is a slurry process using a catalyst prepared in a hydrocarbon oil from a thermally decomposable metal compound catalyst precursor. The catalyst is formed in situ in the hydroconversion zone. See for example, U.S. Pat. Nos. 4,226,742 and 4,244,839 which are incorporated herein by reference.

It is also known to use such catalysts in hydroconversion processes in which coal particles are slurried in a hydrocarbonaceous material. See, for example, U.S. Pat. Nos. 4,077,867 and 4,111,787.

Further, U.S. Pat. Nos. 4,740,295 and 4,740,489, both of which are incorporated herein by reference, teach a method wherein the catalyst is prepared from a phosphomolybdic acid precursor concentrate. The precursor concentrate is sulfided prior to final catalyst formation. This presulfiding step is taught to produce a catalyst having greater control over coke formation. The sulfiding agent in these two patents requires a hydrogen-sulfide containing gas, or a hydrogen-sulfide precursor. The resulting catalyst concentrate is used for hydroconversion of heavy hydrocarbonaceous materials to lower boiling products.

U.S. Pat. No. 4,151,070 teaches a two-stage slurry hydroconversion process in which the second stage is operated at more severe conditions than the first stage stage. The more severe conditions include higher temperatures.

The term "hydroconversion", with reference to a hydrocarbonaceous oil, is used herein to designate a catalytic process conducted in the presence of hydrogen in which at least a portion of the heavy constituents of the oil is converted to lower boiling products. The simultaneous reduction of the concentration of nitrogenous compounds, sulfur compounds, and metallic constituents of the oil may also result.

While there are various hydroconversion and hydrotreating processes which are commercially practiced, there still exists a need for process variations which will increase the level of conversion of higher boiling products to lower boiling products, particularly high quality liquid products.

SUMMARY OF THE INVENTION

In accordance with the present invention, there is provided a two-stage hydroconversion process for converting a heavy hydrocarbonaceous feedstock to lower boiling products which process comprises:

(a) reacting the feedstock in a first reaction stage at hydroconversion conditions which include temperature from about 650° F. to 900° F., and hydrogen partial pressures ranging from about 50 to 5000 psig in the presence of a metal compound which is convertible to a solid, non-colloidal, metal-containing catalyst, which metal is selected from the group consisting of metals from Groups IVB, VB, VIB, VIIB, and VIII, of the Periodic Table of the Elements, wherein said metal compound is: (i) soluble in the hydrocarbonaceous feedstock; or (ii) soluble in an organic medium that can be dispersed in the hydrocarbonaceous feedstock, or (iii) soluble in water resulting in an aqueous solution which can then be dispersed in the hydrocarbonaceous feedstock;

(b) passing the resulting product stream to a second reaction stage where it is reacted under slurry hydrotreating conditions which include: (i) temperatures in the range of about 650° F. to 750° F., with the proviso that this slurry hydrotreating stage be operated at a temperature at least 25° F. less than the first stage, and (ii) hydrogen partial pressures in the range of 800 to 4000 psig, and in the presence of a hydrotreating catalyst comprised of at least one Group VI metal and at least one Group VIII catalyst, on an inorganic oxide support.

In preferred embodiments of the present invention, the feedstock is a hydrocarbonaceous oil having a Conradson carbon content ranging from about 5 to 50 wt. % and the metal of the metal compound which is converted to the catalyst in the hydroconversion stage is selected from the group consisting of molybdenum, tungsten, vanadium, chromium, cobalt, titanium, iron, nickel, and mixtures thereof.

In other preferred embodiments, the metal compound is phosphomolybdic acid.

In yet other preferred embodiments of the present invention, the catalyst of the hydrotreating stage is selected from NiMo, CoMo, and CoNiMo on alumina.

BRIEF DESCRIPTION OF THE FIGURE

The sole figure hereof is a schematic diagram of one process scheme according to this invention comprising a first stage hydroconversion followed by second stage slurry hydrotreating.

DETAILED DESCRIPTION OF THE INVENTION in accordance with the figure hereof, a hydrocarbonaceous feedstock is introduced via line 10 into hydroconversion stage 1. Suitable hydrocarbonaceous feedstocks include crude oils, mixtures of hydrocarbons boiling above 430° F., preferably above 650° F.; for example, gas oils, vacuum residue, atmospheric residue, once-through coker bottoms, and asphalt. The feedstock may be derived from any source, such as petroleum, shale oil, tar sand oil, oils derived from coal liquefaction processes, including coal liquefaction bottoms, and mixtures thereof. Preferably, the hydrocarbonaceous oils, suitable as feedstocks herein, have at least 10 wt. % of substituents boiling above 1050° F. More preferably, the hydrocarbonaceous oils have a conradson carbon content ranging from about 5 to 50 wt. %. Coal may be added to any of these oils. Alternatively, slurries of coal in a hydrocarbon diluent may be used as the chargestock to convert the coal (i.e., coal liquefaction). The diluent may be a single type of light or heavy hydrocarbon, or it may be a mixture of hydrocarbons, as described in U.S. Pat. No. 4,094,765, column 1, lines 54 to column 2, line 43, the teaching of which is incorporated herein by reference.

A catalyst is introduced into the hydroconversion stage via line 12 in either catalyst precursor form or as a catalyst concentrate. It is preferred to introduce the catalyst into the hydroconversion stage as a catalyst concentrate. The catalyst concentrate can be prepared by introducing a catalyst precursor and a suitable hydrocarbonaceous oil into a mixing zone (not shown). Suitable hydrocarbonaceous oils are those comprising constituents boiling above about 1050° F. Preferred are those having at least 10 wt. % constituents boiling above 1050° F., such as crude oils, atmospheric residue boiling above 630° F., and vacuum residue boiling above 1050° F. Preferably, the hydrocarbonaceous oil has an initial boiling point above at least 650° F. and comprises asphaltenes and/or resins. Most preferably, the hydrocarbonaceous oils comprise a lighter boiling oil boiling below about 1050° F. and a heavier oil boiling above about 1050° F. in a blend comprising at least about 22 weight percent materials boiling above 1050° F. Preferred concentrations of the 1050+° F. fraction in the blend include from about 22 to 85 weight percent heavier oil, more preferably about 40 to 75 weight percent heavier oil, based on the total weight of the blend (mixture of oils). The light oil may be a gas oil and the heavier oil may be a vacuum residuum. Alternatively, an atmospheric residuum having the appropriate amount of desired constituents may be used as the oil of line 10.

The catalyst precursor, for the catalyst of the hydroconversion stage, is a metal compound of a metal selected from the group consisting of Groups IVB, VB, VIB, VIIB, and VIII of the Periodic Table of the Elements. The Periodic Table referred to herein is published by Sergeant Welch Scientific Company being copyrighted in 1979 and available from them as Catalog Number S-18856. Non-limiting examples include zinc, antimony, bismuth, titanium, cerium, vanadium,, niobium, tantalum, chromium, molybdenum, tungsten, manganese, rhenium, iron, cobalt, nickel, and the noble metals including platinum, iridium, palladium, osmium, ruthenium, and rhodium. The preferred metal constituent of the metal compound used herein is selected from the group consisting of molybdenum, tungsten, vanadium, chromium, cobalt, titanium, iron, nickel and mixtures thereof. More preferred is molybdenum.

The metal compound may be a compound, or mixture of compounds, as finely divided solids, or a compound or mixture of compounds as finely divided solids mixed with an organic liquid that is soluble in said hydrocarbonaceous oil, a compound or mixture of compounds that is soluble in the hydrocarbonaceous oil or a compound that is soluble in an organic medium (liquid medium), that can be dispersed in the hydrocarbonaceous oil. It can also be water soluble and the resulting aqueous solution dispersed in the hydrocarbonaceous oil. For example, the metal compound may be in a phenolic medium, in water, in alcohol, etc. Suitable metal compounds convertible (under preparation conditions) to solid, metal-containing catalysts include: (1) inorganic metal compounds such as carbonyls, halides, oxyhalides; polyacids such as isopolyacids and heteropolyacids (e.g., phosphomolybdic acid and molybdosilicic acid); (2) metal salts of organic acids such as acyclic and cyclic aliphatic carboxylic acids and thiocarboxylic acids containing two or more carbon atoms (e.g., naphthenic acids); aromatic carboxylic acids (e.g., toluic acid); sulfonic acids (e.g., toluenesulfonic acid); sulfinic acids; mercaptans; xanthic acids; phenols, di- and polyhydroxy aromatic compounds; (3) organometallic compounds such as metal chelates, e.g., with 1,3-diketones, ethylenediamine, ethylenediaminetetraacetic acid, phthalocyanines, etc.; (4) metal salts of organic amines such as aliphatic amines, aromatic amines and quaternary ammonium compounds. Preferred compounds include those from categories (1) and (2) above; more preferred from category (1); and most preferred is phosphomolybdic acid.

When a catalyst concentrate is used, it is preferred that it undergo a drying step to form the corresponding solid catalyst before introduction into the hydroconversion stage.

Returning now to the figure, the feedstock is hydroconverted in hydroconversion stage 1 at suitable operating conditions. Suitable hydroconversion operating conditions are summarized below.

| Conditions | Broad Range | Preferred Range |
|---|---|---|
| Temperature, °F. | 650 to 900 | 820 to 870 |
| $H_2$ Partial Pressure, psig | 50 to 5000 | 100 to 2500 |

The hydroconversion stage effluent is removed via line 14 and passed to a gas-liquid separation zone 2 wherein the normally gaseous phase is separated from a normally liquid phase. It is to be understood that in its broadest aspect, the instant invention need not contain separation zone 2, but instead the entire product from the hydroconversion stage, can be passed to the slurry hydrotreating stage, or stage 3. The gaseous phase is removed from separation zone 2 via line 16. Alternatively, the gaseous phase, which contains hydrogen, may be recycled via line 18, preferably after the removal of undesired constituents. The boiling point cut in this separation zone can vary from about 650° F. to 1050° F., preferably the cut is made at a temperature of 650° F. or 975° F., more preferred is a cut at 650° F. The normally liquid phase, which comprises catalyst solids and a hydroconverted hydrocarbonaceous oil product, is passed via line 20 to slurry hydrotreating stage 3. Alternatively, the catalyst-containing hydroconverted product can first be passed through a filter to remove the catalyst solids. If the cut in separation zone 2 was made at 975° F., the filtrate can then be fractionated whereas the lighter material (650° F.−) can be passed overhead and the heavier material (650° F.+) passed to the slurry hydrotreating stage. Streams passing to the slurry hydrotreating stage from the hotter hydroconversion may first have to pass through a cooler to lower the temperature to that of the slurry hydrotreating stage.

The slurry hydrotreating stage contains an effective amount of a suitable hydrotreating catalyst, which are well-known in the art. Catalyst suitable for use in this stage are those containing at least one Group VI metal and at least one Group VIII metal either unsupported or on an inorganic oxide support. Preferred catalysts include NiMo, CoMo, or CoNiMo combinations, all on an alumina support. In general, sulfides of Group VII metals are suitable. Preferably the catalysts are supported on inorganic oxides such as alumina, silica, titania, silica alumina, silica magnesia and mixtures thereof. Zeolites such as USY, or acid micro supports such as aluminated CAB-O-SIL can be suitably composited with these supports. Catalysts formed in-situ from soluble precursors such as Ni and Mo naphthenate, or salts of phosphomolybdic acids, are also suitable.

In general, the catalyst material may range in diameter from 1 to ⅛ inch. Preferably, the catalyst particles are 1 to 400 microns in diameter so that intra particle diffusion limitations are minimized, or even eliminated, during hydrotreating.

In supported catalysts, the Group VI metals, such as Mo, are suitably present at a weight percent of 5 to 30 atomic %, preferably 10 to 20 atomic %. Promoter metals, such as Ni and/or Co are typically present in an amount ranging from about 1 to 15 atomic %. The surface area of such catalysts are suitably about 80 to 400 m/g, preferably from 150 to 300 m/g.

Methods of preparing such catalysts are well known. Typically, an alumina support is formed by precipitating alumina in hydrous form from a mixture of acidic reagents in an alkaline aqueous aluminate solution. A slurry is formed upon precipitation of the hydrous alumina. This slurry is concentrated and generally spray dried to provide a catalyst support, or carrier. The carrier is then impregnated with catalytic metals and subsequently calcined. For example, suitable reagents and conditions for preparing the support are disclosed in U.S. Pat. Nos. 3,770,617 and 3,531,398, which are incorporated herein by reference. To prepare catalysts up to 200 microns in average diameter, spray drying is generally the preferred method of obtaining the final form of the catalyst particle. To prepare larger size catalysts, for example about 1/32 to ⅛ inch in average diameter, extruding is commonly used to form the catalyst. To produce catalyst particles in the range of 200 to 1/32 inch, the well-known oil drop method is preferred. The oil drop method generally comprises forming an alumina hydrosol by any of the teachings of the art; for example, by reacting aluminum with hydrochloric acid, combining the hydrosol with a suitable gelling agent; and dropping the resultant mixture into an oil bath until hydrogel spheres are formed. The spheres are then continuously withdrawn from the oil bath, washed, dried, and calcined. This treatment converts the alumina hydrogel to corresponding crystalline gamma alumina particles, which are then impregnated with catalytic metals as with spray dried particles. See for example, U.S. Pat. Nos. 3,745,112 and 2,620,314.

It will be understood that the unsupported catalyst solids from the hydroconversion stage which are introduced into the slurry hydrotreating stage, along with the product stream or fraction from the hydroconversion stage, can be recycled in the slurry hydrotreater. If this is done, a Group VIII metal precursor compound can be added to maintain the level of Mo and Group VIII metal in the reactor.

In the slurry hydrotreating stage of the present invention, fresh, or reactivated catalyst is continually added, while aged or deactivated catalyst is purged, or regenerated. The reactivated catalyst is preferably continuously recycled to the reactor. Consequently, the slurry hydrotreating stage can be operated at more severe conditions than a fixed bed hydrotreater.

Returning again to the figure, the slurry hydrotreating stage contains a hydrogen-containing gas. A make-up hydrogen stream may be introduced into the feedstream by way of line 22 before introduction into slurry hydrotreater 3. The hydrotreater will typically contain from about 10 to 70 wt. % catalyst, preferably from about 40 to 60 percent catalyst, by weight. The feedstream may enter through the bottom of the reactor and bubble up through an ebulating, or fluidized bed, of catalyst. The effluent from the slurry hydrotreater is passed via line 24 to a fractionator 4 where it is fractionated into various products. Further, the bottoms, or heavier fraction from the fractionation may be recycled to the slurry hydrotreating stage, via line 26.

Depending on the size of the catalyst particles, the hydrotreating reactor may optionally contain a filter at its exit orifice to keep the catalyst particles inside the reactor. Further, the hydrotreating reactor may alternatively have a flare (increasing diameter) configuration such that when the reactor is kept at minimum fluidization velocity, the catalyst particles are prevented from escaping through an upper exit orifice.

The operating conditions of the slurry hydrotreating stage will include temperatures in the range of 650° to 750° F., preferably between 675° to 725° F. and a pressure from about 800 to 4000 psig, preferably from about 1500 to 2500 psig. The hydrogen treat gas ratio is from about 1500 to 10,000 SCF/B, preferably from about 2000 to 5000 SCF/B. The space velocity (WHSV) is from about 0.2 to 5, preferably from about 0.5 to 2.

The following examples are presented to illustrate the principles of the present invention are not meant to limit the scope of the invention.

EXAMPLE 1

A single stage hydroconversion was run on a Cold Lake resid 975° F. under the following conditions: 810° F.; 0.54 LHSV, or a 1.85 hr residence time, 285 ppm moly, a hydrogen partial pressure of 2,500 psig, and at 6,200 SCF/B. The Cold Lake resid had the following properties:

| | |
|---|---|
| Gravity | 2.3° API |
| Sulfur | 6.63 wt. % |
| Nitrogen | 0.69 wt. % |
| Conradson Carbon | 24.4 wt. % |
| Carbon | 83.35 wt. % |
| Hydrogen | 9.63 wt. % |
| Nickel | 133 wppm |
| Vanadium | 346 wppm |
| Iron | 20 wppm |

The product bottoms were diluted with 1-methyl naphthalene and then filtered to remove the catalyst solids formed in the hydroconversion reactor. The filtered product was then distilled to separate 650° F.+ products from 650° F.− products. These heavier liquids were then treated in a stirred autoclave with presulfided, 32/42 mesh nickel/moly on alumina catalyst commercially available from Akzo Chemical Inc. under the designation KF840. KF840 is reported to be comprised of about 12.7 wt. % Mo, 2.5 wt. % Ni, 6.4 wt. % $P_2O_5$, and has a surface area of about 135 $m^2/g$ and a pore volume of about 0.38 cc/g. It is an alumina supported catalyst. The 32/42 mesh catalyst used in this example was produced by crushing and screening 1.3 mm trilobe extrudates. The conditions of the autoclave test are shown in Table I below. Upon completion of the test, the autoclave was cooled, depressured and the catalyst filtered from the reaction products. This discharged catalyst was then used to treat another charge of filtered, distilled hot separator bottoms. The product was filtered to remove catalyst and analyzed.

Feed to the slurry hydrotreating zone (bottoms from the hydroconversion zone) and product properties are also shown in Table I below. These results show that the bottoms fraction from a first stage hydroconversion was substantially upgraded by use of second stage slurry hydrotreating operation as opposed to the more conventional two stage hydroconversion. The product from the slurry hydrotreater still contains too much organic nitrogen and Conradson carbon to be catalytically cracked directly. However, the boiling point conversion obtained in the slurry hydrotreating step provides a means for rejecting residual Conradson carbon and organic nitrogen from the products. This can be accomplished by fractionating the hydrotreater product into distillate and catalytic cracking feed fractions and a 1050° F. bottoms fraction. This bottoms fraction contains most of the residual Conradson carbon and much of the residual nitrogen.

TABLE I

| 2 Hours, 2000 Psig, 750° F., 3500 SCF/B $H_2$, 40% 32/42 mesh KF-840 on Feed | | |
|---|---|---|
| | Filtered/Distilled Hot Separator BTM's | Slurry Upgraded Product |
| Sulfur, Wt % | 3.33 | 0.446 |
| Nitrogen, wppm | 8700 | 4300 |
| Con Carbon, Wt % | 26.8 | 11.0 |
| Yields, Wt % on Feed | | |
| $C_4$- | | 2.3 |
| $C_5$/650° F. | | 10.6 |
| 650/1050° F. | 49.0 | 72.1 |
| 1050° F+ | 51.0 | 14.9 |

FIG. 1 hereof illustrates one way to combine a hydroconversion processes with a slurry hydrotreating process. This conceptual process corresponds to the experiment described in Example 1 except for the fact that the Figure does not show the filtering of the steam passing from the hydroconversion zone to the slurry hydrotreating zone. There are, of course other ways to combine these two processes which are not shown here. The optimum process configuration will depend on the relative costs of process features such as filtration versus fractionation versus reactor volume versus treat gas recycle etc. it may be more advantageous, for example, to treat unfiltered hot separator bottoms in the slurry hydrotreater and use the product fractionator to separate microcatalyst from products. This would, of course provide an opportunity to recycle unconverted bottoms and catalyst to the hydroconversion stage. Alternatively, the entire hydroconversion effluent could be quenched and treated in the upgrading stage, thereby avoiding treat gas recompression costs. At any rate, the process configuration shown in FIG. 1 merely illustrates the general principles of this invention.

EXAMPLE 2

Yield and qualities for the products from the combined upgrading and single stage conversion processes are shown in Table II below. Yields and product qualities for the corresponding two stage, high conversion hydroconversion process are shown for comparison. As shown in Table II, high overall conversions, of 90% or more, can be achieved with combined hydroconversion and upgrading processes. More importantly, gas yields for this combined hydroconversion/slurry hydrotreating process is substantially lower than for a two stage hydroconversion process al one at equivalent 1050° F. conversions. Moreover, the quality of the product stream is higher for the combined processes.

In this case, average feed residence time for both the hydroconversion and slurry hydrotreating stages was less than the average feed residence time for the two stage hydroconversion process required for the same conversion to 1050° F. products. This was due, in part, to the fact that only the hot separator bottoms produced in the first hydroconversion stage were treated in the slurry hydroprocessing stage. Nonetheless, it is surprising that a process employing a relatively low temperature hydrotreating stage could provide higher boiling point conversion at equivalent residence time than a process employing a higher temperature, hydroconversion second stage.

TABLE II

| Cold Lake Resid Conversion via | Two Stage Hydroconversion | | Single Stage Slurry Upgrading |
|---|---|---|---|
| Avg. Feed Residence Time, Hrs. | 3.1 | 4.5 | 2.8 |
| Conversion, 1050° F. | 90 | 95 | 91 |
| Yields, Wt % | | | |
| $C_1$-$C_4$ | 11 | 14 | 7 |
| $C_5$/350° F. | 16 | 19 | 10 |
| 350/650° F. | 34 | 37 | 25 |
| 650/1050° F. | 29 | 23 | 47 |
| VGO Quality | | | |
| N,wppm | 8800 | 9500 | 4000 |
| First Stage Temperature | 825 | 825 | 810 |
| Second Stage Temperature | 835 | 835 | 750 |
| Con Carbon, Wt. % | 2.2 | 2.8 | 1.5 |

What is claimed is:

1. A process wherein a two-stage hydroconversion process for converting a heavy hydrocarbonaceous feedstock to lower boiling products which process consists essentially of:

(a) reacting the feedstock in a first reaction stage which is a hydroconversion stage, at temperatures from about 650° F. to 900° F., and hydrogen partial pressure ranging from about 50 to 5000 psig in the presence of a phosphomolybdic acid;

(b) passing the resulting product stream to a second reaction stage which is a slurry hydrotreating stage where it is reacted at: (i) temperatures in the range of 650° F. to 750° F., with the proviso that this slurry hydrotreating stage be operated at a temperature at least 25° F. less than the temperature of said first stage, and (ii) hydrogen partial pressures in the range of 800 to 4000 psig, and in the presence of hydrogen and a hydrotreating catalyst comprised of at least one Group VI metal and at least one Group VIII catalyst, on an inorganic oxide support; and (c) passing the product stream of said hydrotreating stage to a separation zone wherein a 975° F.+ stream and one more or more streams having an average boiling point less than 975° F. are produced; and (d) collecting said one or more streams boiling less than about 975° F. and any portion of the 975° F.+ stream is not recycled to the hydrotreating stage; and (e) recycling at least a portion of said 975° F.+ stream to said hydrotreating stage of step (b).

2. The process of claim 1 wherein the product stream from the hydroconversion stage is passed to a separation zone in which the stream is separated into a 975° F.+ stream and a 975° F.− stream with the 975° F.+ stream being passed to the slurry hydrotreating stage and the 975° F.− stream being collected overhead.

3. The process of claim 1 wherein the heavy hydrocarbonaceous feedstock has at least 10 wt. % of its substituents boiling above about 1050° F.

4. The process of claim 1 wherein the catalyst composition, prior to introduction into the hydroconversion stage, is first prepared as a concentrate by mixing, in a mixing zone, phosphomolybdic acid and a hydrocarbonaceous oil.

* * * * *